US006681863B1

(12) United States Patent
Odelros

(10) Patent No.: US 6,681,863 B1
(45) Date of Patent: Jan. 27, 2004

(54) METHOD AND DEVICE FOR PREVENTING DISTRIBUTION OF FIRE GASES IN A VENTILATING SYSTEM

(75) Inventor: Anders Odelros, Hedesunda (SE)

(73) Assignee: Polmannen AB, Gavle (SE)

( * ) Notice: Subject to any disclaimer, the term of this patent is extended or adjusted under 35 U.S.C. 154(b) by 0 days.

(21) Appl. No.: 09/889,674

(22) PCT Filed: Jan. 18, 2000

(86) PCT No.: PCT/SE00/00086

§ 371 (c)(1),
(2), (4) Date: Jul. 19, 2001

(87) PCT Pub. No.: WO00/43072

PCT Pub. Date: Jul. 27, 2000

(30) Foreign Application Priority Data

Jan. 19, 1999 (SE) ..... 9900132

(51) Int. Cl.[7] ..... A62C 37/00

(52) U.S. Cl. ..... 169/56; 169/60; 169/48; 169/45; 454/255; 454/369; 236/49

(58) Field of Search ..... 169/45, 43, 48, 169/49, 56, 60, 61; 454/369, 255; 236/49

(56) References Cited

U.S. PATENT DOCUMENTS

| | | | | | |
|---|---|---|---|---|---|
| 4,084,744 | A | * | 4/1978 | Wilson, Jr. | 454/369 |
| 4,177,716 | A | * | 12/1979 | Bowe et al. | 169/61 |
| 5,589,643 | A | * | 12/1996 | Pyle | 73/861.75 |
| 5,787,919 | A | * | 8/1998 | Pyle | 454/369 |
| 6,293,861 | B1 | * | 9/2001 | Berry | 454/255 |

* cited by examiner

*Primary Examiner*—Dinh Q. Nguyen
(74) *Attorney, Agent, or Firm*—Young & Thompson

(57) ABSTRACT

A method and device for preventing distribution of fire gases in a ventilating system that serves a number of fire compartments (15, 16), the ventilating air, during normal operating conditions, having a certain predetermined direction of flow at the inlet side and the outlet side of the fire compartments (15, 16). It is significant that when a predetermined lowest pressure drop is registered, for the ventilating air in the direction of flow, over a measuring spot at the inlet side or the outlet side, a blocking is effected of the flowing area of the ventilating air past the measuring spot.

5 Claims, 6 Drawing Sheets

METHOD AND DEVICE FOR PREVENTING DISTRIBUTION OF FIRE GASES IN A VENTILATING SYSTEM

CROSS REFERENCE TO RELATED APPLICATION

This is the 35 USC 37 national stage of International Application PCT/SE00/00086 filed on Jan. 18, 2000, which designated the United States of America.

TECHNICAL FIELD OF THE INVENTION

The present invention relates to a method and a device for preventing distribution of fire gases in a ventilating system that serves a number of fire compartments, the ventilating air, during normal operating conditions, having a certain predetermined direction of flow at the inlet side and the outlet side of said fire compartments.

PRIOR ART

From SE-B-442 338 a device adapted to prevent distribution of fire gases in a ventilating system is previously known. This device relies on the principle that self actuated non-return valves, arranged in the ducts of the ventilating system, are kept open by a pressure drop that is present over said valves, said pressure drop being generated by a fan device allotted to said ventilating system. Each of said valves are arranged to automatically close when the pressure drop ceases. If such a valve is arranged at the inlet side of a fire compartment and a pressure is developed in said fire compartment, e.g. in connection with a fire, said pressure may remove the pressure drop over the valve, said valve automatically closes and the supply of ventilating air to the fire compartment ceases. Air is sucked out through the valve at the outlet side as long as the fan device is operating. This sucked out air is not able to enter any other fire compartment due to the valve that is arranged at the outlet side of the other fire compartments.

The arrangement described above has the disadvantage that an accurate mounting of the valves is necessary since their function relies on the attraction of gravity. Further, energy losses are present if the valves are to open at air flows of low velocity.

Ventilating systems with non-return valves are previously known from SE-B-459 522 and SE-B-460 434, said non-return valves being developed from the device according to SE-B-442 338, said device thus aiming at the prevention of distributing fire gases. The further developed ventilating systems are also aiming at the prevention of fire distribution. In order to realize this the non-return valves are equipped with a heat sensitive means, e.g. a fuse, that releases a closing of the non-return valves when the temperature adjacent the valves exceeds a certain value.

It is also previously known to register the presence of fire gases in a ventilating system by providing smoke detectors in the ducts of the ventilating system. However, a number of disadvantages are connected with said smoke detectors. Firstly, it should be mentioned that it is difficult to position the smoke detectors, especially if they are to detect smoke from several fire compartments. A further disadvantage is that the function of the smoke detector depends on the type of smoke that is generated, i.e. the smoke detector indicates only for certain type/types of smoke. This means that it is extremely complicated to check whether a smoke detector functions. Further, the smoke detector normally does not indicate until the duct is filled with smoke. Unsuccessful positioning or a quick fire progress may cause extensive fire damages in other fire compartments. In this connection it should also be considered that the smoke detector is comparatively expensive.

OBJECTS AND FEATURES OF THE INVENTION

A primary object of the present invention is to define a method and a device that in an effective way prevent distribution of fire gases in a ventilating system.

According to a preferred embodiment the principle of the present invention may also be used in connection with varying air velocities in the ventilating system.

A further object of the present invention is that indication in order to prevent fire distribution should also be effected.

At least the primary object of the present invention is realized by means of a method and a device that have been given the features of the appending independent claims. Preferred embodiments of the invention are defined in the dependent claims.

BRIEF DESCRIPTION OF THE DRAWINGS

Below embodiments of the present invention will be described, reference being made to the accompanying drawings, where.

DETAILED DESCRIPTION OF PREFERRED EMBODIMENTS OF THE PRESENT INVENTION

Figure 1:
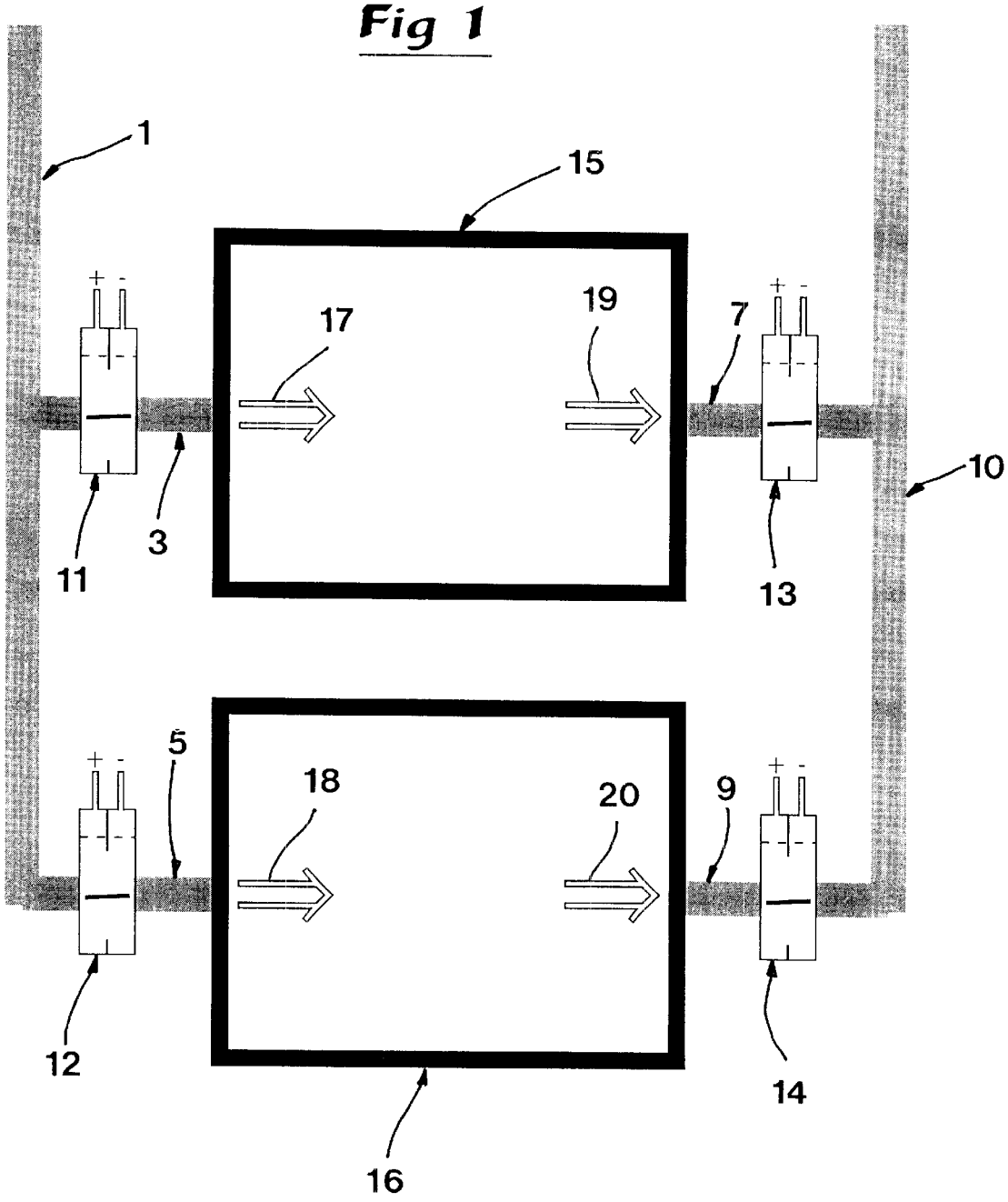
FIG. 1 shows a schematic view of a ventilating system according to the present invention, said ventilating system being connected to two fire compartments.
Figure 4:
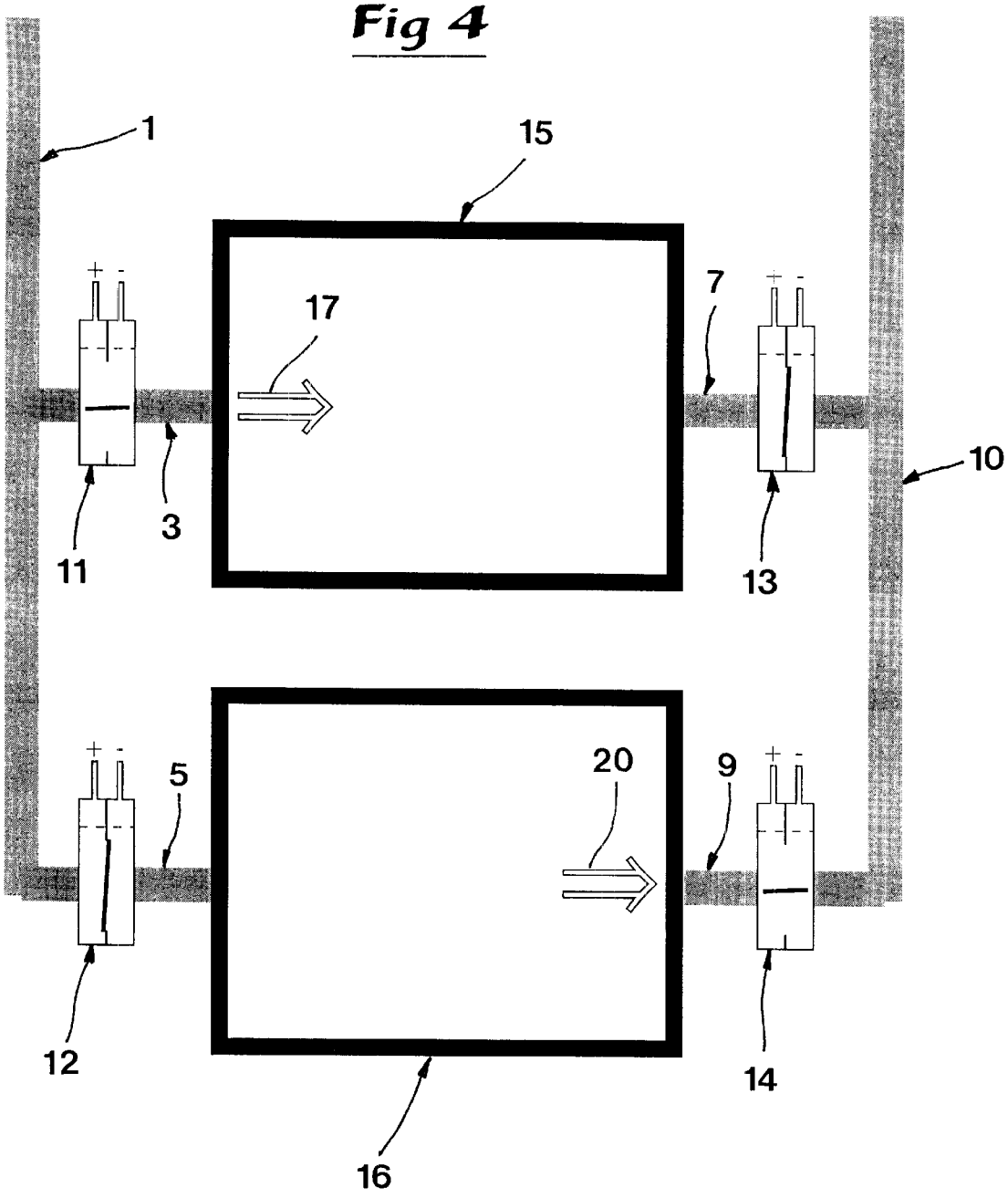
FIG. 4 shows a schematic view of the ventilating system according to FIG. 1, where two of the valves are closed.

The ventilating system, shown schematically in FIGS. 1 and 4, comprises a main duct 1 for supply air, a first and a second branch duct 3 and 5 respectively for supply air, a first and a second branch duct 7 and 9 respectively for exhaust air and a main duct 10 for exhaust air. A first valve means 11 is provided in the first branch duct 3 for supply air, a second valve means 12 is provided in the second branch duct 5 for supply air, a third valve means 13 is provided in the first branch duct 7 for exhaust air and a fourth valve means 14 is provided in the second branch duct 9 for exhaust air. The plus signs and the minus signs, + and – respectively, of each valve means 11–14 symbolize that the pressure drop of the ventilating air is measured over the valve means 11–14.

In FIG. 1 the ventilating system according to the present invention is connected to a first and a second fire compartment 15 and 16 respectively, the arrows 17–20 symbolize the normal direction of flow of the air in the ventilating system, i.e. ventilating air is supplied to the fire compartments 15 and 16 via the main duct 1 and the branch ducts 3 and 5 while ventilating air is exhausted from the fire compartments 15 and 16 via the branch ducts 7 and 9 and the main duct 10. In order to effect flow of the ventilating air according to the arrows 17–20 the ventilating system according to the present invention also comprises air transporting means, e.g. fans, that are not disclosed in FIG. 1.

In the disclosed embodiment the valve means 11, 12, 13 and 14 are of the type where a damper of each valve means is pivotally mounted, said damper may seal against abutments of the valve means. A preferred valve means will be described schematically with reference to FIGS. 2 and 3.

Figure 2:
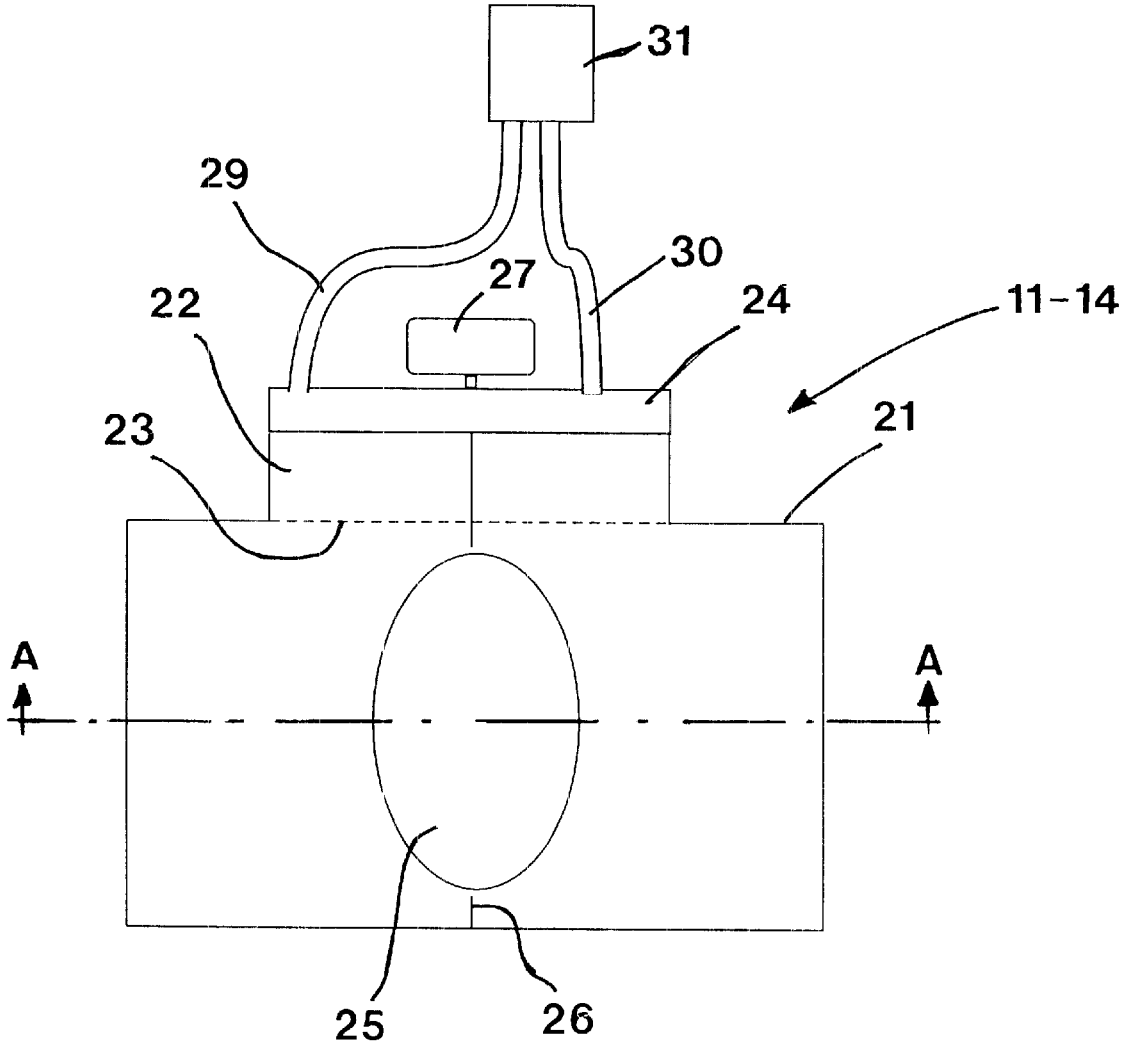
FIG. 2 shows a schematic side view, in enlarged scale, of a ventilating means that is incorporated in the to ventilating system.
Figure 3:
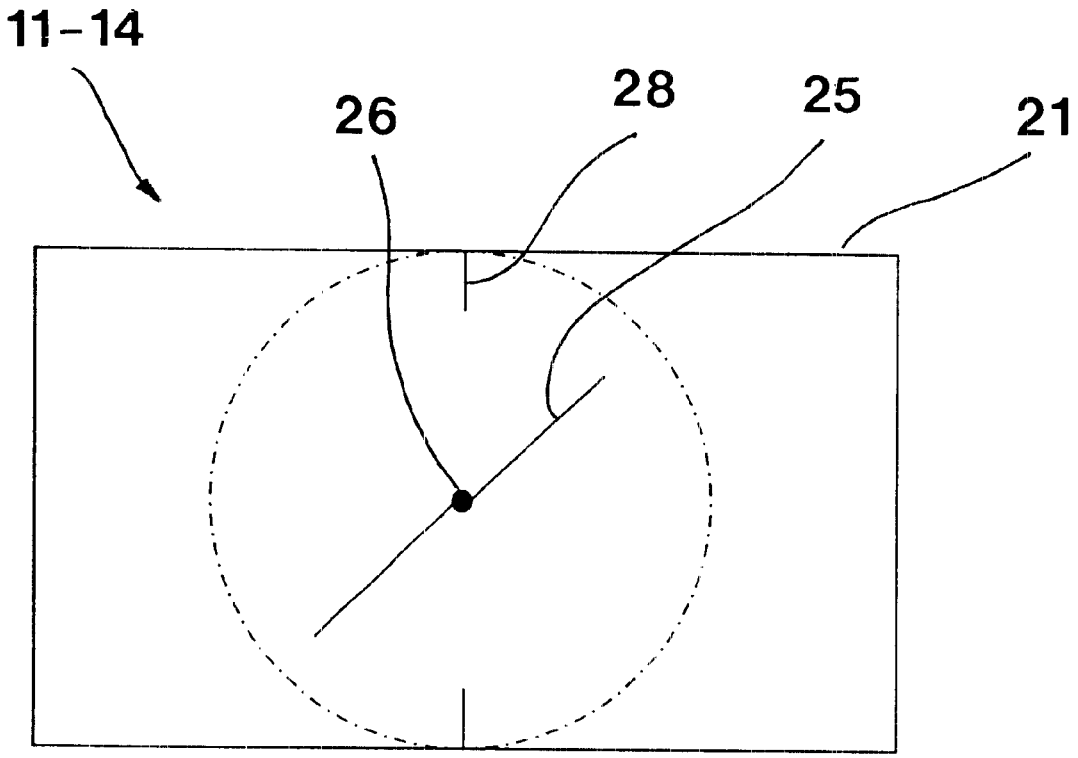
FIG. 3 shows a section along A—A in FIG. 2.

In each of the branch ducts 3–9 a valve means 11–14 according to FIG. 2 and 3 is provided. Said valve means 11–14 comprises a duct portion 21 that he is intended to constitute a portion of respective branch duct 3–9. Above the duct portion 21 in FIG. 2 a chamber 22 is provided, said duct portion 21 and the chamber 22 being defined by a perforated metal sheet 23. The chamber 22 also has a lid 24 that can be removed from the chamber 22 for inspection and service. A damper 25 of the valve means 11–14 is pivotable around a shaft 26 that extends through the chamber 22 and the lid 24. Said shaft 26 is connected to an operating means 27 by means of which the shaft 26 may be brought to rotate. Said operating means 27 preferably constitutes an electric motor but also other types of operating means are possible within the scope of the invention. As is most evident from FIG. 3 an abutment 28 is provided inside the duct portion 21 of the valve means 11–14. The opening defined by said abutment 28 is normally adapted to the shape of the damper 25, i.e. if the damper 25 is circular, the opening defined by the abutment 28 is also preferably circular.

Means for measuring the pressure drop over the damper 25 is provided in the chamber 22, said means being shown schematically in FIG. 2. A first measuring means 29 measures the pressure of the ventilating air before the damper 25 while a second measuring means 30 measures the pressure of the ventilating air after the damper 25. It is an essential benefit that the measuring of the air pressure takes place within the chamber 22, i.e. inside the perforated sheet 23. Thereby, an essentially absolute static air pressure is established that is not influenced by the turbulence of the air. Said first and second measuring means 29 and 30 respectively are connected to a registering means 31, which in its turn is connected to the operating means 27 in order to activate said operating means 27 when the damper 25 is to be closed or its opening degree is regulated.

The Functional Mode of the Present Invention

With reference primarily to FIG. 4 the principle function of the invention will be described. However, initially reference is made to FIG. 1, where the normal ventilating process is illustrated. In connection with said normal ventilating process the air pressure in the left portion of the valve means 11–14 is higher than the air pressure in the right portion, said ventilating air flowing according to the arrows 17–20. The present invention is based on the principle to measure the direction of flow of the ventilating air.

If it is assumed that fire breaks out in the fire compartment 16 a high positive pressure is created in this fire compartment 16, the consequence of this being that the air pressure at the right side of the valve means 12 will increase, which in its turn brings about that the air flow in direction of the arrow 18, see FIG. 1, decreases. This is equivalent with a decrease of the pressure drop over the damper 25, said operating means 27 being adjusted in such a way that when the pressure drop has decreased to a certain predetermined limit value the operating means 27 is activated and the damper 25 is closed. In such a way it is avoided that fire gas of the inlet side is pressed into the duct system the reversed way via the second branch duct 5 for supply air.

In this connection it should be pointed out that of practical measuring reasons the damper 25 is closed when the pressure drop has such a magnitude that it can be registered by means of reasonably advanced measuring equipment, however the principle of the invention is still based on the supervision of the direction of flow of the air when the chosen pressure drop guarantees that the air flows in a certain direction.

At the outlet side of the fire compartment 16, see arrow 20 in FIG. 4, the fire gas is allowed to exit into the fourth branch duct 9 and further out into the main duct 10 of the exhaust air. However, fire gas will not enter into the fire compartment 15 the reversed way, via the valve means 13 in the first branch duct 7 of exhaust air. The reason therefore is that the increase of pressure that is generated in the main duct 10 for exhaust air, by the fire in the fire compartment 16, will induce an increase of pressure in the right portion of the valve means 13, this in its turn induces an increased resistance against the exhaust air that bypasses said valve means 13. Thus, when the pressure drop over the valve means 13 has decreased to a certain predetermined value the damper 25 in the valve means 13 is closed in a corresponding way as the valve means 12.

As is evident from the description above there is a straight connection between the direction of flow of the ventilating air through the valve means 11–14 and the pressure drop that is registered over said valve means 11–14. To register the direction of flow of the ventilating air by measuring the pressure drop over a valve means is thus the basic principle of the present invention.

Figure 7:
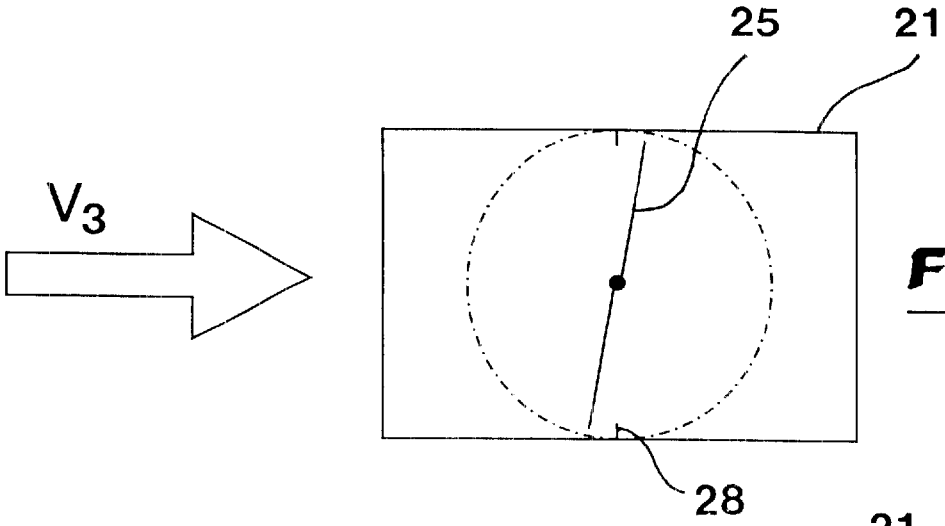
FIGS. 5–7 show schematically the valve means according to FIG. 2 at different operating conditions of the ventilating system.
Figure 6:
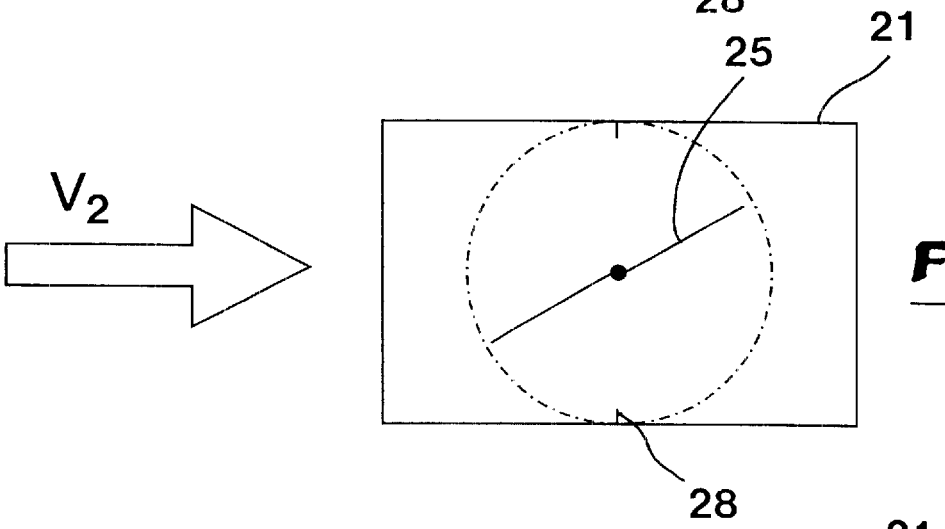
Figure 5:
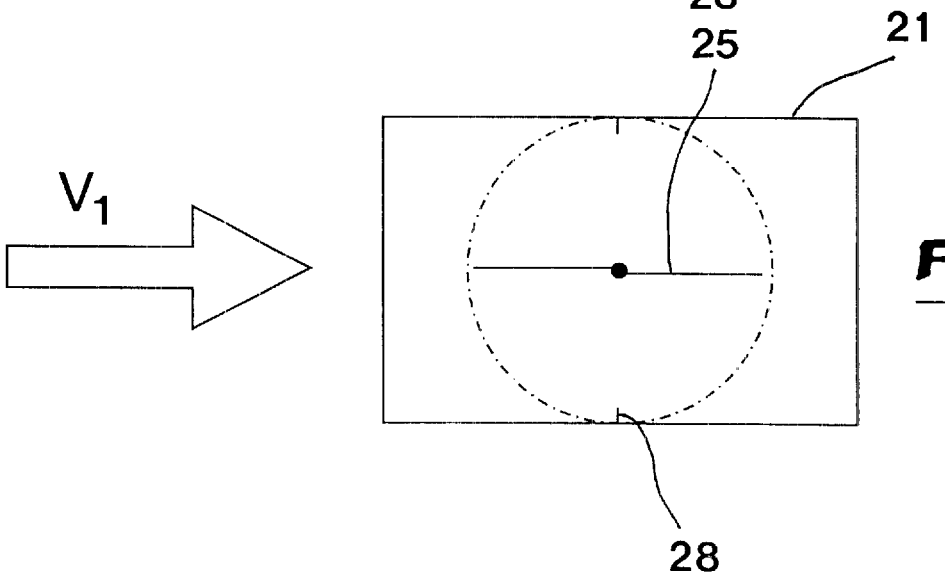
Figure 11:
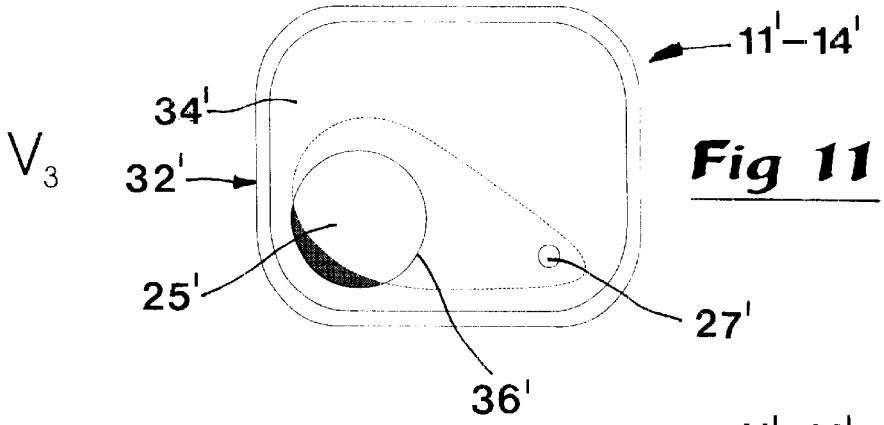
FIGS. 9–11 show schematically the ventilating means according to FIG. 8 at different operating conditions of the ventilating system.
Figure 10:
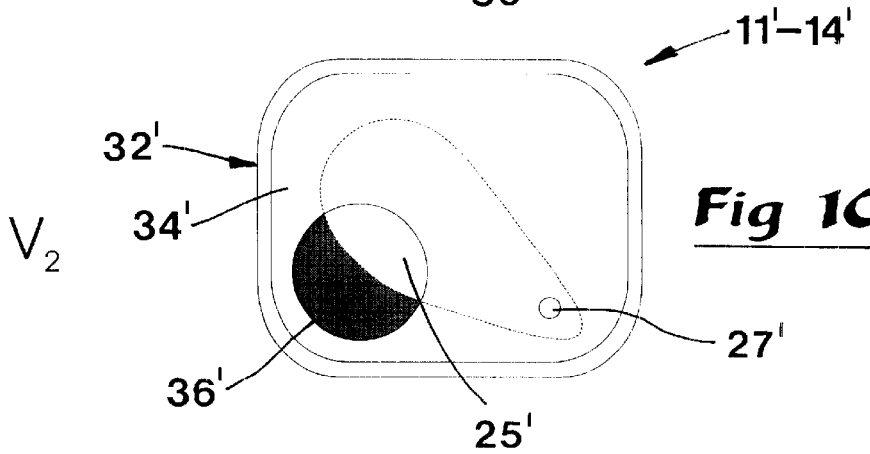
Figure 9:
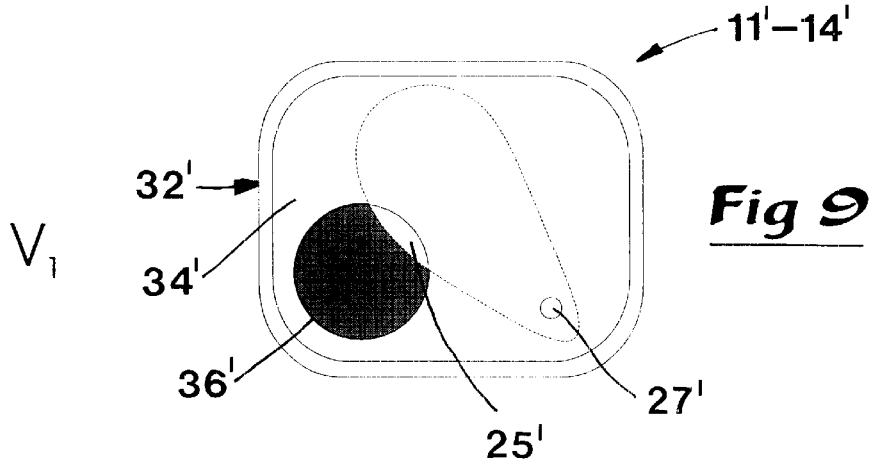
Figure 8:
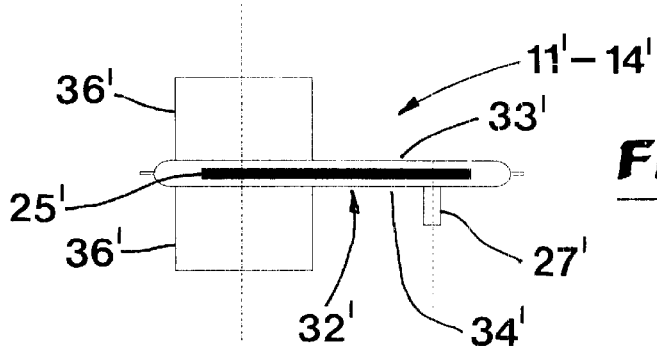
FIG. 8 shows schematically an alternative embodiment of a ventilating means.

The above described structural design of the valve means 11–14 also allows that a sufficient pressure drop, in order to avoid closing of the damper 25, is maintained over the valve means 11–14 also at a relatively moderate velocity of the ventilating air. With reference to FIGS. 5–7 a number of different operating conditions of the ventilating system according to FIGS. 1 and 4 will be illustrated. In this connection it should be pointed out that for all disclosed operating conditions a certain predetermined lowest pressure drop $\Delta P$ is present over the valve means 11–14. The following formula is used in order to facilitate the understanding of the principle that the present invention is based upon:

$\Delta P = \rho \times v^2 \times \zeta$; where $\rho$=the density of the air;

$v$=the velocity of the air before the valve means; and $\zeta$=coefficient of resistance of the valve means.

For all disclosed operating conditions the density on the air $\rho$ is the same.

In connection with the operating condition of FIG. 5 the damper 25 is completely open, i.e. the coefficient of resistance $\zeta_1$ is relatively seen low. In order to compensate for this, i.e. to achieve the lowest acceptable pressure drop $\Delta P$, the air velocity $v_1$ must be, relatively seen, high. The operating condition disclosed in FIG. 5 illustrates the case when the ventilating system is operating at a high level, i.e. there is a high air circulation in the fire compartments 15 and 16.

In the operating condition shown in FIG. 6 the damper 25 is somewhat more closed, i.e. restricted, than in the operating condition according to FIG. 5. This means that the coefficient of resistance $\zeta_2$ has a higher value than in the operating condition according to FIG. 5 and it is directly realized that the air velocity $v_2$ may be lower without going below the predetermined lowest pressure drop. The operating condition according to FIG. 6 is present when the ventilating system is operating at an intermediate level.

In the operating condition shown in FIG. 7 the damper 25 is further closed, i.e. restricted, compared to the operating condition according to FIG. 6. This means that the coefficient of resistance $\zeta_3$ has a higher value than the coefficient of resistance $\zeta_2$ in the operating condition according to FIG. 6 and consequently the air velocity $V_3$ may be lower than the air velocity $v_2$ in the operating condition according to FIG. 6. The operating condition according to FIG. 7 may for instance be present at night when the ventilating system is operating at a very low level.

Generally the air velocity v and the coefficient of resistance $\zeta$ has a direct mutual connection, i.e. a lower air velocity v must be compensated by a higher coefficient of resistance $\zeta$ and vice versa in order not to go below the lowest permitted pressure drop $\Delta P$. In this connection it should also be considered that the formula given above includes the air velocity in square, and therefore a change in the air velocity has a higher penetration.

As is realized from the illustrated different operating conditions according to FIGS. 5–7 a certain opening degree of the damper 25 corresponds to a certain lowest air velocity and below this velocity the damper 25 moves to a more closed position. In this connection it should be considered that if for instance in the operating condition according to FIG. 6 the air velocity $v_2$ decreases below the predetermined value the damper 25 will move towards a closed position but since the coefficient of resistance increases the damper 25 will not close completely. The pending air velocity is for instance sufficient for the operating condition according to FIG. 7 and hence this operating condition is assumed, this in practice being what happens when the ventilating system transfers from operating at an intermediate level to operate at a low level. This mode of function is not negative as regards the security aspect of the described ventilating system. If it is assumed that a fire having a vigorous progress breaks out in the fire compartment 16 in FIG. 4 the pressure in said fire compartment 16 will quickly increase to such a level that the pressure drop for the ventilating air over the valve means 12 completely disappears or even becomes negative, i.e. the pressure at the side facing towards the fire compartment 16 of the valve means 12 is higher than the pressure at the side of the valve means 12 facing towards be main duct 1. In such a case the damper 25 of the valve means 12 is of course completely closed since, as has been mentioned above, a lowest predetermined, in practice suitable, pressure drop $\Delta P$ may be 20 Pa.

The principle of the invention functions also at the situation when the ventilating systems transfers from operating at a low level, see FIG. 7, to operate at an intermediate level, see FIG. 6. In such a case the air velocity increases from $V_3$ to $v_2$, which means that the registered instantaneous pressure drop increases and the damper 25 is opened to the position according to FIG. 6. At a further increased air velocity $v_1$ the damper 25 will be able to assume the position according to FIG. 5 without getting below the predetermined pressure drop.

In this connection it should also be pointed out that the use of the principle described above as regards the relationship between the air velocity and the coefficient of resistance $\zeta$ makes it possible that, in the same building, different fire compartments may be supplied air having different velocity. By regulating the restriction of the dampers 25 compensation can be achieved for a difference in air velocity, i.e. a pressure drop is maintained that is higher than the predetermined pressure drop.

In FIGS. 8–11 an alternative embodiment of a valve means 11'–14' is shown, i.e. said valve means 11'–14' may replace the valve means 11–14 in the embodiment described above. As is evident from FIGS. 8–11 the valve means 11'–14' constitutes a combined single leaf damper and slide damper, said damper comprising a frame 32' that in its turn comprises to parallel sheets 33' and 34' that between themselves define a space. The damper itself constitutes a leaf 25' that is pivotally received in said space between the sheets 33' and 34'. The leaf 25' is connected to a pivot pin 27' that in the disclosed embodiment extends through one sheet 34'. Said pivot pin 27' is in its turn connected to a motor or other power source (not shown), the pivot pin 27' and the motor having principally the same function as the operating means 27 according to the embodiment described above. Thus, the non-disclosed motor may turn the pin 27' and hence the leave 25' around the point where the pin 27' penetrates the sheet 34'. When displacing the leave 25' the sheets 33' and 341 serve as guides for the leaf 25'.

On each of the sheets 33' and 34' a spigot 36' is provided, said spigot 36' being connected to a corresponding opening in the adherent sheet 33', 34'. The spigots 36' are located opposite to each other and adapted to be connected to air ducts in the ventilating system where the valve means 11'–14' is installed.

The reasoning, carried out above in connection with the embodiment described above, as regards the function of the present invention at different operating conditions, i.e. that a sufficient pressure drop may be maintained over the valve means 11–14 in order to prevent closing of the damp to 25 also at a relatively moderate velocity of the ventilating air, is pertinent also for the alternative embodiment of the valve means 11'–14' disclosed in FIGS. 8–11. The operating condition shown in FIG. 9, having the air velocity $v_1$, corresponds to the operating condition shown in FIG. 5, the operating condition shown in FIG. 10, having the air velocity $v_2$, corresponds to the operating condition shown in FIG. 6 and the operating condition shown in FIG. 11, having the air velocity $V_3$, corresponds to the operating condition shown in FIG. 7. In order to achieve the different operating conditions, schematically illustrated in FIGS. 8–10, the leaf 25' is displaced in such a way that it to a varying degree covers the through flowing area of the air that passes the valve means 11'–14'.

As regards registering of the pressure drop over the valve means 11'–14', this can be effected by a principally corresponding means as schematically is shown in FIG. 2.

To a sum up it should be pointed out that the basic principle of the present invention is that the flow path of the ventilating air is blocked when a certain lowest, predetermined pressure drop is measured over a measuring spot that normally constitutes a damper or the like. In its most simple design this damper may only assume two positions, i.e. opened or closed.

Feasible Modifications of the Invention

In connection with the function described above it is assumed that the damper 25 is adjusted automatically in correspondence to the measured pressure drop $\Delta P$ over the valve means 11–14, i.e. that the operating means 27 in a suitable way is connected to the registering means 31. However, within the scope of the invention it is also feasible that the adjustment of the dampers 25 is carried out manually, i.e. when the velocity in the system is decreased the dampers 25 are restricted, the degree of restriction being achieved empirically.

According to the embodiments described above the area regulating means constitute different types of single leaf dampers and slide dampers 25; 25'. However, within the scope of the present invention it is feasible to have different types of dampers or other structural designs of the area regulating means.

The device according to the present invention may of course be completed by a fire thermostat or the like in order to protect against fire distribution.

In order to achieve an extremely reliable indication that the damper 25; 25' has assumed its closed position when the predetermined pressure drop is registered said damper 25; 25' may be brought to actuate a micro switch in connection with the attaining of said closed position.

What is claimed is:

1. Device for preventing distribution of fire gases in a ventilating system that serves a number of fire compartments having an inlet side and an outlet side, said ventilating system comprising inlet ducts for supplying ventilating air to the fire compartments and outlet ducts to exhaust ventilating air from the fire compartments, such that the ventilating air, during normal operating conditions, has a certain predetermined direction of flow at the inlet side and the outlet side of said fire compartments;

valve means being provided in the inlet ducts and the outlet ducts in connection with said fire compartments;

said valve means comprising means for regulating a flowing area of the ventilating air;

wherein the device comprises means for registering, over a measuring spot in connection with said flowing area regulating means, an instantaneous pressure drop of the ventilating air in said predetermined direction of flow, and operating means for each flowing area regulating means; said operating means, in connection with registration of a predetermined lowest pressure drop for the ventilating air over said measuring spot, being adapted to actuate the adherent area regulating means to block the flowing area of the ventilating air past said measuring spot.

2. The device according to claim 1, wherein the means for registering the instanteaneous pressure drop cooperate with the operating means in such a way that a decrease of the pressure drop results in a decreased opening degree of the flowing area regulating means, and an increase of the pressure drop results in an increased opening degree of the flowing area regulating means.

3. The device according to claim 1, wherein the flowing area regulating means comprises dampers.

4. The device according to claim 1, further comprising a chamber provided in connection with each of the valve means; said chamber being screened off from the turbulence of the flowing ventilating air, and the means for registering the pressure drop over the measuring spot are connected to said chamber.

5. The device according to claim 4, wherein a the screening of the chamber is carried out by a perforated sheet.

* * * * *